US005210549A

United States Patent [19]

Takahashi

[11] Patent Number: 5,210,549

[45] Date of Patent: May 11, 1993

[54] INK JET RECORDING HEAD HAVING RESISTOR FORMED BY OXIDIZATION

[75] Inventor: Hiroto Takahashi, Yokohama, Japan

[73] Assignee: Canon Kabushiki Kaisha, Tokyo, Japan

[21] Appl. No.: 711,419

[22] Filed: Jun. 5, 1991

Related U.S. Application Data

[63] Continuation of Ser. No. 367,327, Jun. 16, 1989, abandoned.

[30] Foreign Application Priority Data

Jun. 17, 1988 [JP] Japan ..... 63-148173

[51] Int. Cl.[5] ..... B41J 2/05

[52] U.S. Cl. ..... 346/140 R; 29/610.1; 29/890.1; 148/DIG. 117; 338/308

[58] Field of Search ..... 346/140 R, 1.1; 338/308; 29/890.1, 611, 610.1, 846; 148/DIG. 117

[56] References Cited

U.S. PATENT DOCUMENTS

| | | | |
|---|---|---|---|
| 4,333,226 | 6/1982 | Abe | 148/DIG. 117 |
| 4,460,938 | 7/1984 | Clei | 361/411 |
| 4,490,728 | 12/1984 | Vaught | 346/140 X |
| 4,535,343 | 8/1985 | Wright | 346/140 |
| 4,596,994 | 6/1986 | Matsuda | 346/140 |
| 4,694,306 | 9/1987 | Ikeda | 346/140 |
| 4,777,494 | 10/1988 | Shibata | 346/140 X |
| 4,847,630 | 7/1989 | Bhaskar | 346/140 X |
| 4,847,639 | 7/1989 | Sugata et al. . | |
| 4,860,033 | 8/1989 | Shiozaki | 346/140 |

FOREIGN PATENT DOCUMENTS

| | | |
|---|---|---|
| 0140611 | 5/1985 | European Pat. Off. . |
| 0286204 | 10/1988 | European Pat. Off. . |
| 3403643 | 8/1984 | Fed. Rep. of Germany . |
| 62-201254 | 9/1987 | Japan . |

*Primary Examiner*—Joseph W. Hartary

*Attorney, Agent, or Firm*—Fitzpatrick, Cella, Harper & Scinto

[57] ABSTRACT

An ink jet recording head comprises a discharging opening for liquid discharge and an electricity-heat convertor. The electricity-heat convertor has a region formed by oxidation of at least part of an electroconductive material, and the region is adapted to generate heat.

12 Claims, 10 Drawing Sheets

DEVELOPMENT

HEAT GENERATING RESISTOR LAYER ETCHING

RESIST REMOVAL

PROTECTIVE FILM FORMATION

FILM FORMATION

RESIST COATING

EXPOSURE

DEVELOPMENT

ANODIC OXIDATION

RESIST REMOVAL

PHOTOSENSITIVE RESIN COMPOSITION LAMINATION

EXPOSURE

DEVELOPMENT

TOP PLATE ADHESION

ANODIC OXIDATION FOR ADJUSTING RESISTANCE OF HEAT GENERATING RESISTOR

CORRESPONDING TO FIG. 3(d)

CORRESPONDING TO FIG. 3(e)

CORRESPONDING TO FIG. 3(f)

CORRESPONDING TO FIG. 3(i)

INK JET RECORDING HEAD HAVING RESISTOR FORMED BY OXIDIZATION

This application is a continuation of application Ser. No. 07/367,327 filed Jun. 16, 1989, now abandoned.

BACKGROUND OF THE INVENTION

1. Field of the Invention

This invention relates to a substrate for an ink jet recording head, an ink jet recording head having the same and methods for preparing them.

2. Related Background

An ink jet recording method is a recording method which performs recording by discharging an ink (liquid for recording) through discharging openings provided on a recording head and attaching this onto a recording medium such as paper, etc., having many advantages such that generation of noise is very small, and also high speed recording is possible and yet no paper for recording of special constitution is required, etc. and various types of recording heads have been developed.

Among them, the recording head of the type which permits heat energy to act on ink, thereby discharging the ink through discharging openings has advantages such as good response to recording signals and easy arrangement of multiple discharging openings at high density.

The recording head to be used for such recording method has typically a constitution as shown in the schematic perspective view of FIG. 1. Specifically, it is provided with a discharging opening 101 provided for forming flying droplets by discharging ink and a liquid channel 102 for supplying ink communicated to said discharging opening. An electricity-heat converting element having a heat generating resistor which is a heat energy generator 104A is provided internally of the liquid channel 102 and electrodes for supplying current to the heat-generating resistor and a liquid chamber 103 for storing ink to be supplied into the liquid channel is provided upstream side of the liquid channel. In addition, a recording head can also be provided with, if necessary, a protective film having the action of enhancing ink resistance of the electricity heat converting element.

Such head is generally prepared as shown in FIG. 2. FIG. 2 shows schematic sectional views of the preparation steps at the position when the recording head is cut at the A—A' portion shown in FIG. 1. First, the layer 251 a part of which becomes finally the heat generating resistor (hereinafter called heat-generating resistance layer) and the layer 252 a part of which becomes electrodes (hereinafter called electrode layer) are formed on a support 253 (steps (a), (b)). Then, the electrode layer 252 is subjected to patterning utilizing a photolithographic technique by use of photoresist 254 and an etching technique, and subsequently, the heat-generating resistance layer 251 is similarly subjected to patterning to form heat-generating resistor and electrodes (steps (c) to (k)). Specifically, on the product (b) after completion of the step (b) is laminated a photoresist 254 such as photosensitive resin, etc. (step (c)), the photoresist 254 of the product (c) is subjected to pattern exposure (step (d)), followed by developing of the photoresist 254 of the product (d) (step (e)). By the step (e), the photoresist 254 has only unnecessary portions removed in a desired pattern shape. Next, the electrode layer 252 exposed on the product (e) is removed by etching (step (f)), and the remaining resist portion 254' of the product (f) thus prepared is removed (step (g)). Thus, a desired pattern of the electrode layer 252 is formed.

The pattern of the heat-generating resistance layer 251 is also formed according to the same steps as in the case of forming the pattern of the electrode layer 252. That is, the pattern of the heat generating resistance layer 251 is formed by lamination of the photoresist 254'' (step (h)), pattern exposure on the photoresist of the product (h) by use of a photomask (step (i)), developing of the photoresist 254'' subjected to pattern exposure of the product (i) for removal of unnecessary portions (step (j)) and etching of the exposed heat-generating resistance layer 251 of the product (j) (step (k)). Then, the resist 254 is peeled off (step (l)). Next, after a protective film 255 having the purposes of ink resistance, etc. is formed (step (m)), a photosensitive resin 256 is laminated (step (n)), followed by exposure (step (o)) and development (step (p)), to form a wall 256' with the hardened film of the photosensitive resin subjected to patterning ((m) to (p)). This wall constitutes the liquid channel wall which can be filled with a liquid. Next, on the wall 256' is plastered a ceiling 257, and thereafter discharging opening is formed by cutting (not shown) to complete an ink jet recording head (step (q)).

Thus, the preparation method which has been used in the prior art comprises many steps, and in addition, it takes a long time for some of the steps, particularly the etching step. It has been recognized that too much preparation time is required. Also, there is room for improvement also from the point that the positional precisions of the individual members are worsened, because the number of patterning steps is high.

SUMMARY OF THE INVENTION

The present invention has been accomplished in order to solve the above problems, and its object is to provide a substrate for an ink jet recording head which can effect shortening of the preparation time and has good positional precisions of the respective members, and an ink jet recording head having it. Another object of the present invention is to provide methods for preparing them.

Still another object of the present invention is to provide an ink jet recording head comprising a discharging opening for liquid discharge and an electricity-heat convertor, said electricity-heat convertor having a region formed by oxidation of at least part of an electroconductive material, said region being adapted to generate heat.

Still another object of the present invention is to provide a process for preparing a substrate for a recording head having on a support an electricity-heat convertor utilized for liquid discharge, which comprises forming a layer of electroconductive material on said support and oxidizing at least part of the surface region of said layer to form the electrodes and heat-generating resistor portion of said electricity-heat convertor.

Still another object of the present invention is to provide a process for preparing a substrate for a recording head having on a support an electricity-heat convertor utilized for liquid discharge, which comprises forming a layer of electroconductive material on said support, oxidizing part of said layer to make it an oxide, and oxidizing at least part of the surface region of residual electroconductive portion to form the electrodes and heat-generating resistor portion of said electricity-heat convertor.

Still another object of the present invention is to provide an ink jet recording head comprising a discharging opening provided for forming flying droplets by liquid discharge and an electricity-heat convertor having a heat-generating resistor and a pair of electrodes electrically connected to said heat-generating resistor, said electrodes and said heat-generating resistor being formed of the same material.

Still another object of the present invention is to provide a process for preparing an ink jet recording head which comprises steps of (a) forming on a support a film having an electroconductive property and heat resistance and being capable of anodic oxidation;

(b) anodizing the region of said film other than regions becoming electrodes and a heat-generating resistor;

(c) laminating a photosensitive composition;

(d) removing partially said photosensitive composition to form at least a discharging opening and wall members and expose the region of said film becoming a heat-generating resistor;

(e) plastering a top plate; and (f) anodizing the exposed surface of said film to form a heat-generating resistor while leaving the unanodized region of said film as electrodes.

DESCRIPTION OF THE PREFERRED EMBODIMENTS

Figure 1:
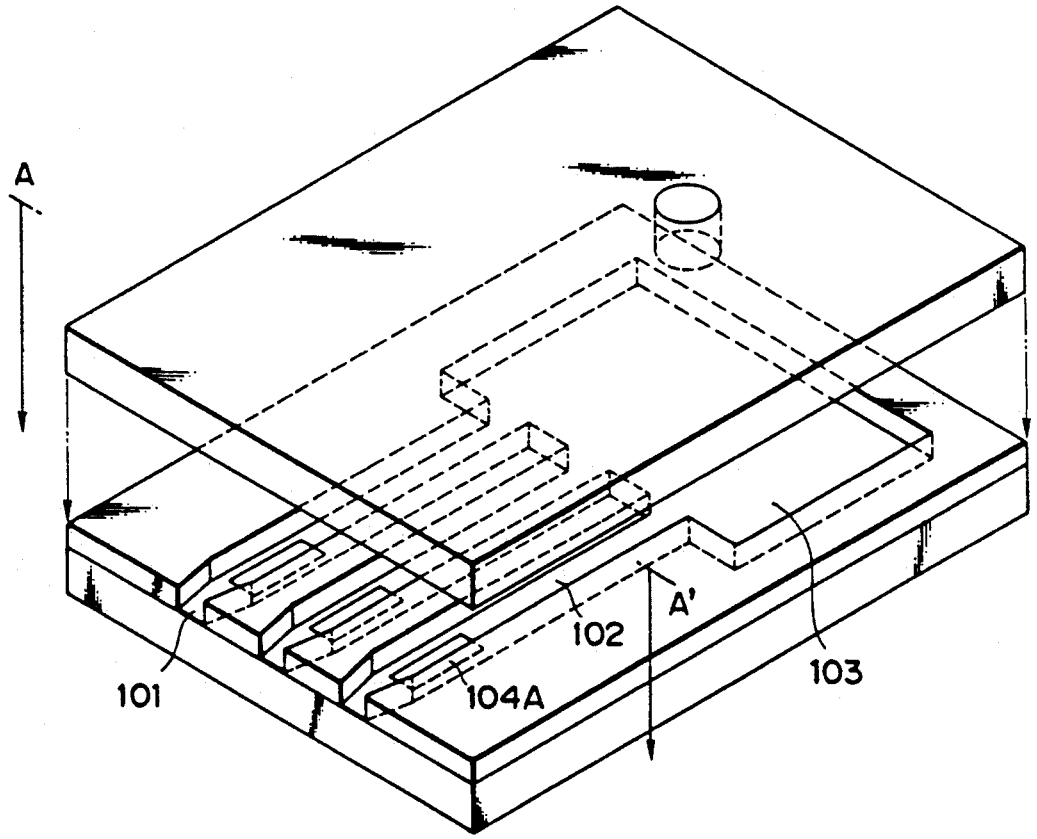
FIG. 1 PRIOR ART
FIG. 1 is a schematic perspective view of a typical constitution of a recording head for ink jet recording.
Figure 2A:
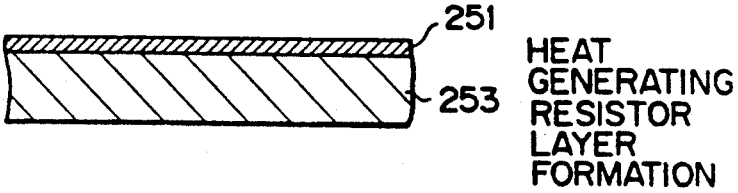
FIG.2(a) PRIOR ART
FIGS. 2(*a*)–2(*q*) shows schematic sectional views of the preparation steps at the position when the recording head is cut at the A—A' portion shown in FIG. 1.
Figure 2B:
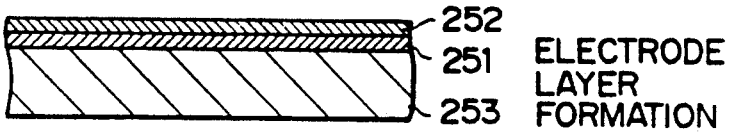
FIG.2(b) PRIOR ART
Figure 2C:
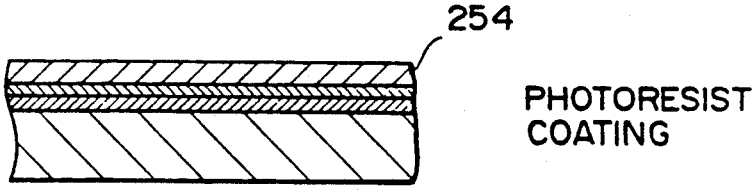
FIG.2(c) PRIOR ART
Figure 2D:
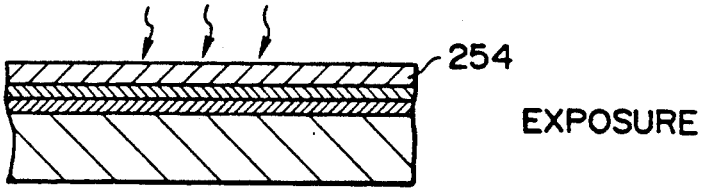
FIG.2(d) PRIOR ART
Figure 2E:
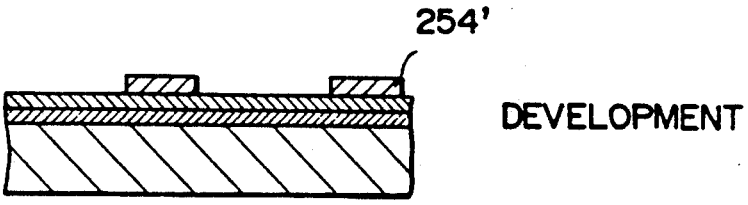
FIG.2(e) PRIOR ART
Figure 2F:
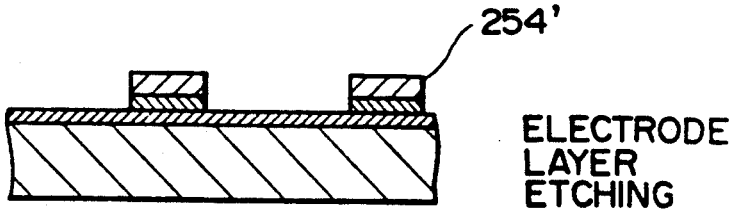
FIG.2(f) PRIOR ART
Figure 2G:
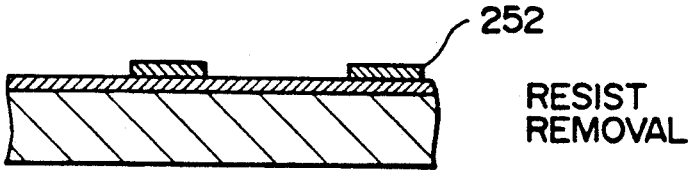
FIG.2(g) PRIOR ART
Figure 2H:
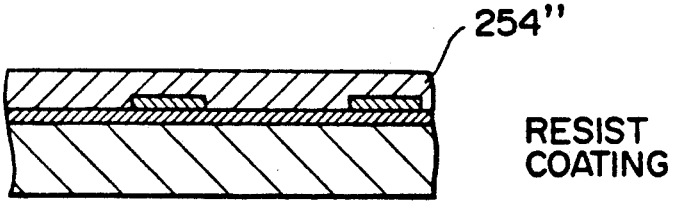
FIG.2(h) PRIOR ART
Figure 2I:
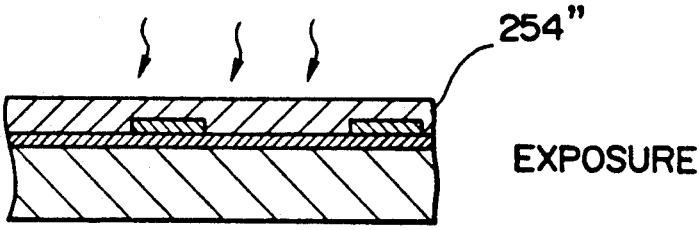
FIG.2(i) PRIOR ART
Figure 2J:
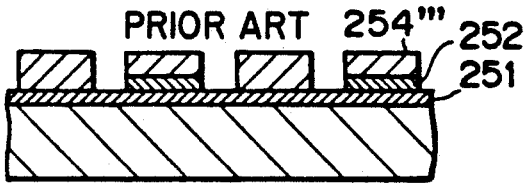
FIG.2(j) PRIOR ART
Figure 2K:
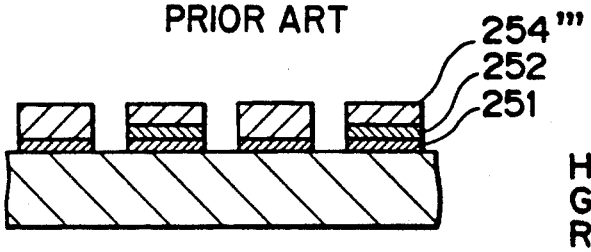
FIG.2(k) PRIOR ART
Figure 2L:
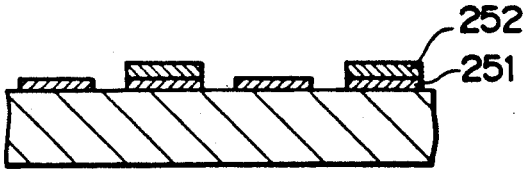
FIG.2(l) PRIOR ART
Figure 2M:
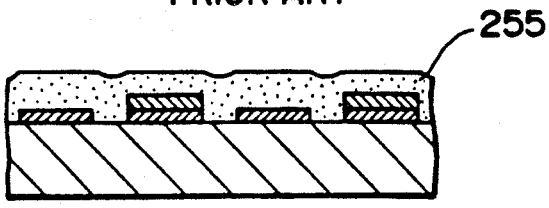
FIG.2(m) PRIOR ART
Figure 2N:
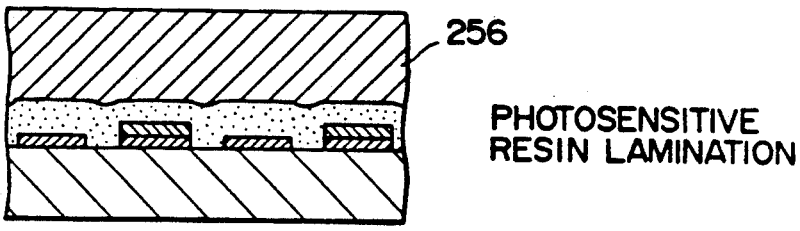
FIG.2(n) PRIOR ART
Figure 2O:
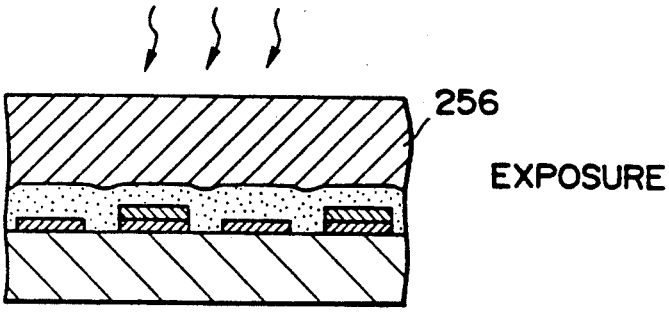
FIG.2(o) PRIOR ART
Figure 2P:
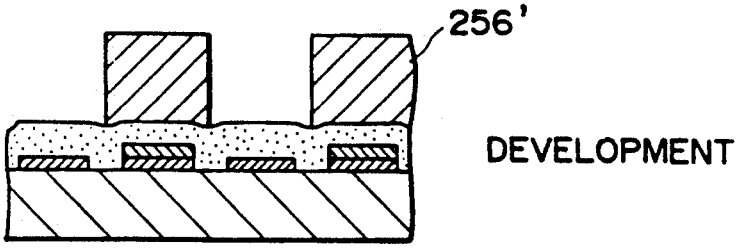
FIG.2(p) PRIOR ART
Figure 2Q:
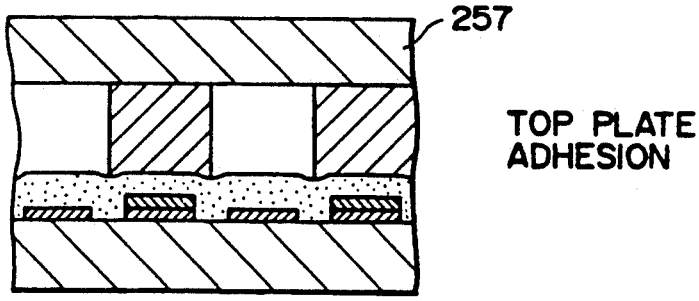
FIG.2(q) PRIOR ART
Figure 3A:
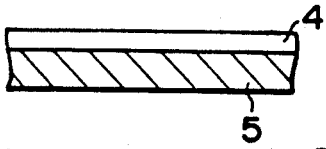
FIGS. 3(*a*)–3(*k*) shows schematic sectional views of the preparation steps of a recording head of the present invention.
Figure 3B:
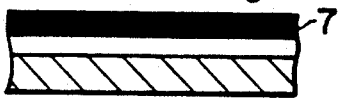
Figure 3C:
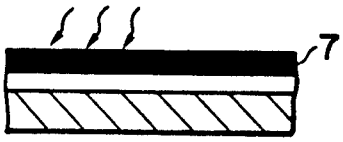
Figure 3D:
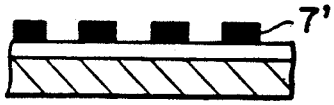
Figure 3E:
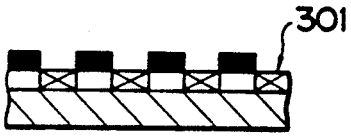
Figure 3F:
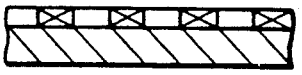
Figure 3G:
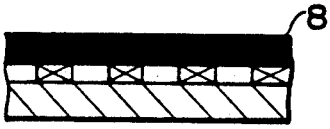
Figure 3H:
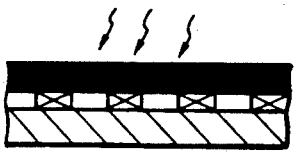
Figure 3I:
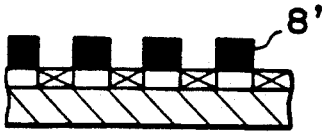
Figure 3J:
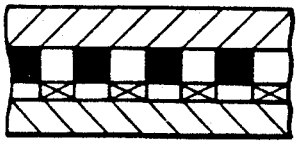
Figure 3K:
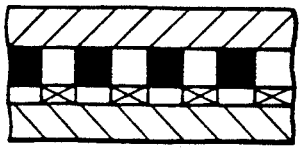
Figure 4A:
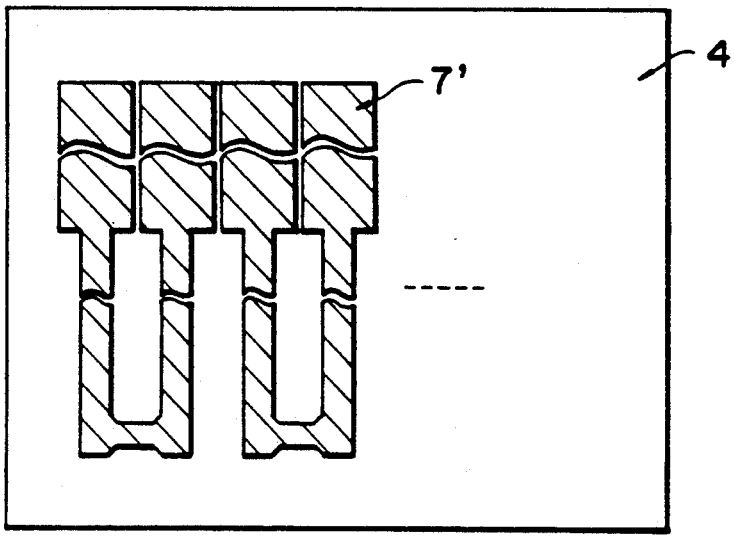
FIGS. 4(*a*) to 4(*d*) are schematic plan views of the prepared products corresponding to FIGS. 3(*d*), (*e*), (*f*) and (*i*), respectively.
Figure 4B:
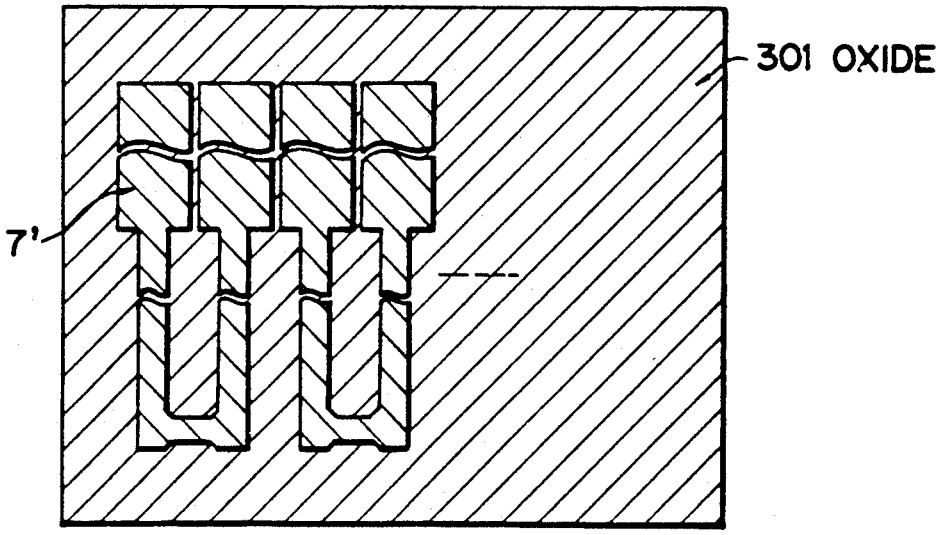
Figure 4C:
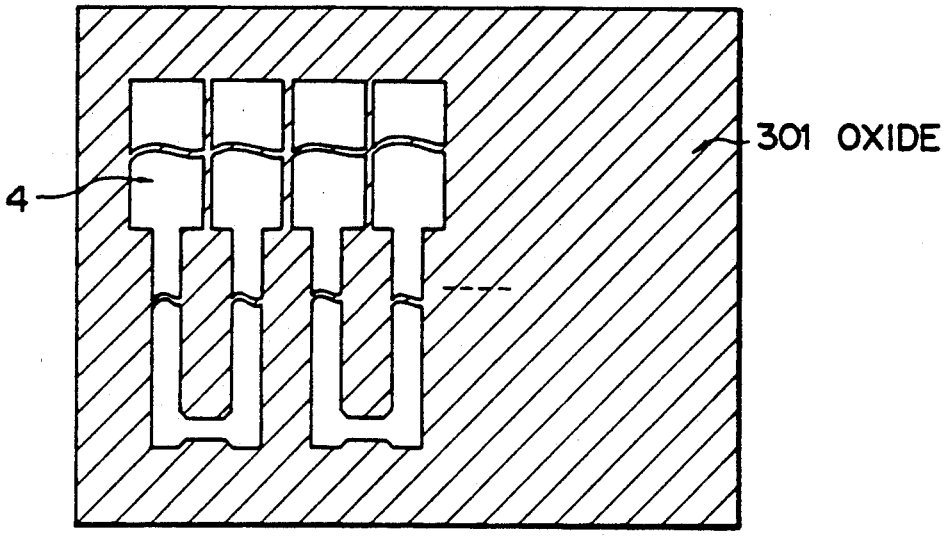
Figure 4D:
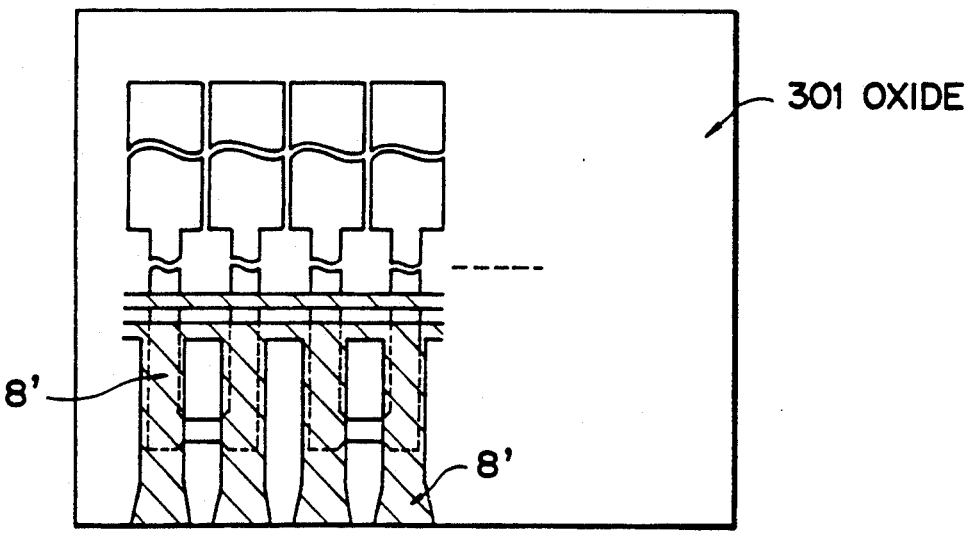

A preferable example of the present invention is described below by referring to the drawings.

First, the present invention is briefly described by referring to FIG. 1 showing an embodiment of an ink jet recording head in an assembly diagram. That is, the ink jet recording head to which the present invention is suitably applied is an ink jet recording head having a discharging opening 1 provided for forming flying droplets by discharging a liquid as represented by ink, a liquid channel 2 for supplying the liquid to the discharging opening 1, a liquid chamber 3 for storing the liquid to be supplied to the liquid channel 2 provided upstream thereof, a heat-generating resistor which is. A heat energy source for forming flying droplets by discharging the liquid is provided corresponding to the liquid channel 2, and at least a pair of electrodes electrically are connected to the heat-generating resistor on a substrate 5 and form an electricity-heat converter 4A with a pair of electrodes and the heat-generating resistor. The substrate comprises one material selected for the above heat-generating resistor and electrodes and the same material which has been oxidized. Also, the methods for preparing such substrate and recording head are proposed here.

Such ink jet recording head can be prepared according to, for example, the steps of:

(a) forming a film which exhibits electroconductivity and heat resistance, and can be anodically oxidized on a substrate;

(b) anodically oxidizing the above film except for the portions which become electrodes and heat-generating resistor to convert it into an insulating material;

(c) laminating a photosensitive composition wholly thereon;

(d) removing partially the photosensitive composition to form at least the discharging opening and the liquid channel side face simultaneously with exposing the above film at the portion which becomes the heat-generating resistor;

(e) plastering the ceiling plate and (f) introducing an electrolyte into the liquid chamber and the channel formed in the step (e), oxidizing the exposed surface of the above film by anodic oxidation to form the heat-generating resistor. The details are described by referring to FIGS. 3(*a*) to (*k*).

FIGS. 4(*a*) to (*d*) show schematic plan views of the prepared products corresponding to FIG. 3(*d*), (*e*), (*f*) and (*i*), respectively. That is, FIG. 4(*a*) shows the state when the step shown in FIG. 3(*d*) is practiced, FIG. 4(*b*) that shown in FIGS. 3(*e*), FIG. 4(*c*) that shown in FIG. 3(*f*) and FIG. 4(*d*) that shown in FIG. 3(*i*).

It should be noted that the schematic sectional view of the recording head shown in FIG. 1 as described above does not coincide with the shape of the recording head shown below in the preparation procedure as described below.

First, on a support 5 such as glass, etc., a material which can become both the heat generating resistor and the electrodes is formed into a film ((a)). As the material, those which exhibit heat resistance and electroconductivity after film formation, and can be anodically oxidized can be utilized. For example, Ta, V, Nb, Zr, Mg, Zn, Ni, Gd, Co, etc. may be employed. The thickness of the film formed (film of the starting material) 4 should be preferably made about 500 to 20000 Å. The film forming method may be determined depending on the material and, for example, the vacuum deposition method generally known in the art such as sputtering, vacuum vapor deposition, etc. may be preferably utilized.

Subsequently, in the completed product, the film 4, except for the portions which become the heat-generating resistor and electrodes is covered with a resist 7. For this purpose, the lithographic technique known in the art may be utilized ((b) to (d)).

Next, the film at the portion not covered with the resist 7 is converted to an insulating material by the anodic oxidation method (e), and thereafter, the resist 7 is peeled off. As the treating solution to be used in this case, there may be included aqueous solutions of boric acid, tartaric acid, malonic acid, phosphoric acid, etc. These aqueous solutions may be preferably used particularly for anodic oxidation of Ta film.

Figure 5:
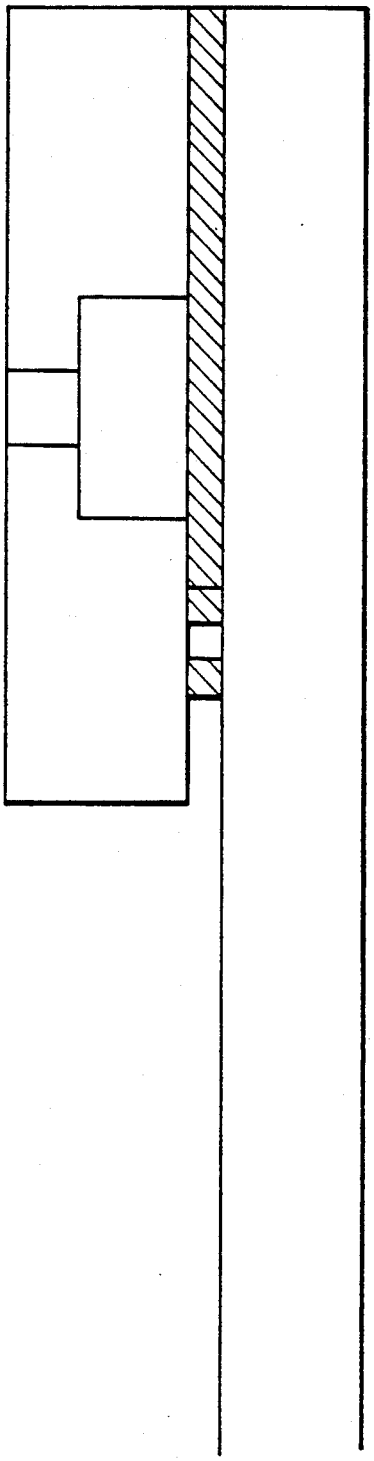
FIG. 5 is a sectional view of the completed product corresponding to V—V' in FIG. 7.

Subsequently, the photosensitive resin 8 of dry film, etc. is wholly laminated (g). Thereafter, partial exposure and developing are practiced to effect patterning of the photosensitive resin 8 to form a pattern of the cured layer of the photosensitive regin ((h)–(i)). The cured layer defines the liquid channel and the discharging opening. For this step, a material which can be finely patterned after lamination can be utilized, including photosensitive resins. A schematic plan view of the product completed up to this step is shown in FIG. 4(*d*), and a sectional view (sectional view corresponding to V—V' in FIG. 7) of the completed product for reference in FIG. 5. The dashed portion in FIG. 4 shows the portion converted to insulating material by anodic oxidation, and the dotted portion is the portion where the photosensitive composition is provided.

As shown in FIG. 4(*d*), care is taken so that the film at the portion which becomes the heat-generating resistor may not be covered with the photosensitive resin 8 at least after patterning, and the film at the portion which becomes electrodes may be covered with the photosensitive resin 8. However, since this is the point which should be considered for practicing the later step (FIG. 4(*k*)) within the range having no trouble, even the film at the portion which becomes electrodes may be the portion where no such point should be taken into consideration as a matter of course in view of the operation of that step.

Next, on the cured layer 8' of the photosensitive resin defining the liquid channel and the discharging opening, etc., a ceiling 6 of glass, etc. is plastered (adhered) to form the liquid channel, etc. Finally, an electrolyte solution (treating solution) containing an electrolyte is introduced into the liquid chamber and the liquid channel and again anodic oxidation is practiced ((k) the portion to be anodically oxidized is not shown). By doing so, the film surface at the portion which is not covered with the cured layer of the photosensitive resin is converted into an oxide to form a heat-generating resistor, and resistance at this portion is increased by using the oxide as the protective film, thus completing the ink jet recording head as shown in FIG. 1.

In the case as described above, the first anodic oxidation should preferably convert the portion to be anodically oxidized completely to an insulating material, while the second anodic oxidation should be effected so that adequate electroconductivity may remain at the portion to be anodically oxidized. Thus, the respective anodic oxidations are required to be practiced corresponding to these requirements.

The ink jet recording head completed as described above is formed of the heat-generating resistor and electrodes by use of the same material as the starting material, but the heat-generating resistor is essentially thinner than the portion other than that, namely electrodes, to be greater in resistance value.

The anodic oxidation of the film 4 which is the starting material in the above step will be described in more detail.

The case of forming tantalum (Ta) as the starting material film on the support will be specifically described below.

Based on the steps (a) to (d) in FIG. 3, the support having the cured film of photosensitive resin provided on Ta film with a thickness of 1000 Å was subjected to anodic oxidation treatment by use of 1% by weight of an aqueous phosphoric acid solution as the treating solution at a current density of 10 mA/cm$^2$ for a treatment time of 120 sec. By this treatment, the Ta film in contact with the treating solution was oxidized substantially completely in its thickness direction to be converted into an insulating material (FIG. 3, step (e)).

Next, after the ceiling plate of the recording head was bonded based on the steps (f) to (k) in FIG. 3, 1% by weight of an aqueous phosphoric acid solution was supplied into the recording head, and by oxidizing anodically the surface portion of the Ta film so that a desired resistance value may be obtained at a current density of 5 mA/cm$^2$ to form the portion which becomes the heat-generating resistor (FIG. 3, step (k)).

When recording was performed practically by supplying ink to the ink jet recording head thus prepared, recording could be done with extremely stable discharging characteristics.

In the foregoing examples, when the width of electrodes can be taken greater than that of the heater, the second anodic oxidation only of the heater region (by which heater resistance can be made sufficiently greater than electrode resistance) becomes unnecessary.

Figure 6:
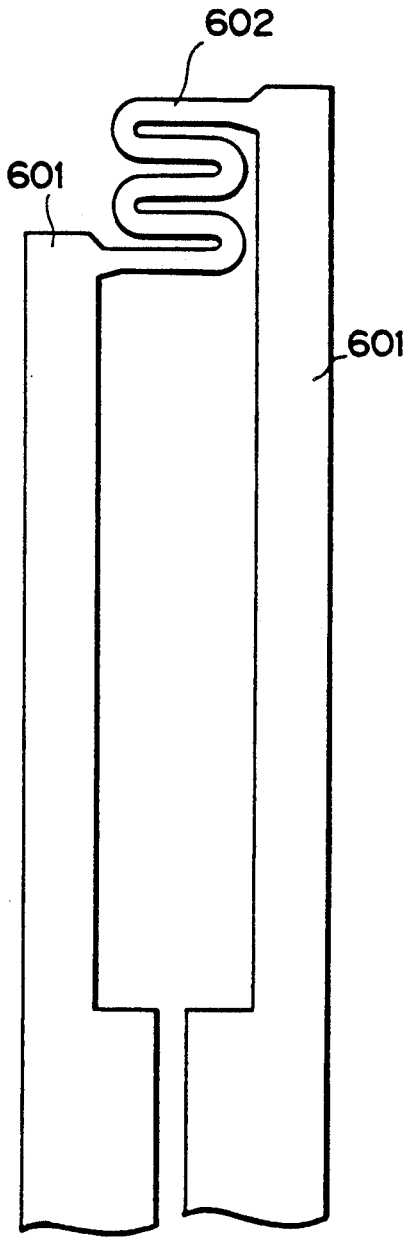
FIG. 6 is a schematic plan view showing the shape of an electrode region and a resistance heating region.

The shapes of the electrode region and the heat-generating resistor region may be any desired ones as shown in the schematic plan view in FIG. 6. In FIG. 6, 601 is the electrode region and 602 the heat-generating resistor region.

Figure 7:
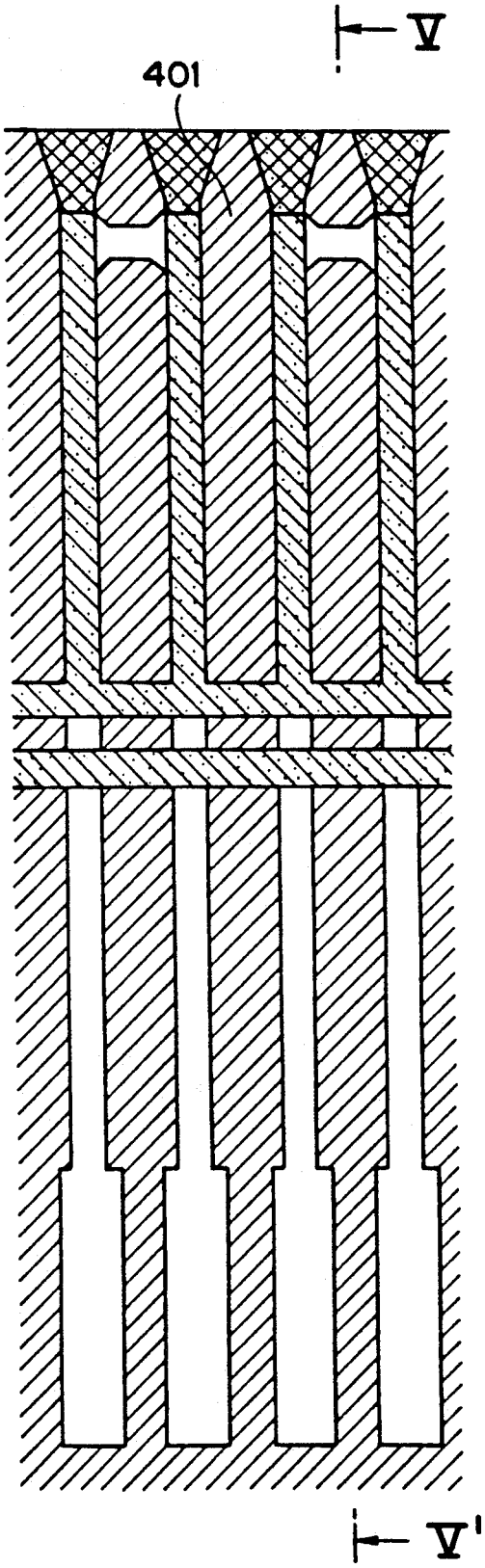
FIG. 7 is a schematic plan view, partially enlarged, of FIG. 4(*d*).

As shown in FIG. 4(*d*), the pattern formed of the cured film of the photosensitive resin may have the liquid channel formed corresponding to the heat-generating resistor portion. Therefore, the cured film of the photosensitive resin may be also provided in the region 401 in FIG. 4(*d*). FIG. 7 is a schematic plan view, partially enlarged, of FIG. 4(*d*).

In the above description, the substrate under the state where the electrode region and the heat-generating resistor portion region are formed by anodic oxidation may be previously formed, and the liquid channel, etc. may be formed thereof to prepare a recording head.

The gaps between the respective heat-generating resistance elements are not necessarily required to be anodically oxidized, but unnecessary portions may be removed by etching, and the electrode region and the heat-generating portion forming the heat-generating resistance elements can be also anodically oxidized, if desired, to form heat-generating resistance elements.

Effect of the Invention

As described in detail above, in the present invention, since the ink jet recording head can be prepared by two patterning steps and one film forming step, the number of steps can be shortened to a great extent. Also, according to the present invention, patterning is possible only by anodic oxidation without utilizing etching step, and in addition to the above reason, preparation time can be also effected in this respect. Further, according to the present invention, the location positional precisions of the respective members can be improved.

In addition, according to the present invention, since the upper surface of the heat-generating resistance element (substrate upper surface) has little unevenness, peeling of the respective members, etc. will occur with difficulty, whereby a recording head enriched in durability can be provided.

Also, within the scope of the present invention, the preparation order of the recording head, the constitution of the recording head can be changed as desired as a matter of course.

What is claimed is:

1. An ink jet recording head comprising:

a substrate having a plurality of electricity-heat convertors, each electricity-heat convertor comprising a heat-generating resistor for generating heat utilized for discharging ink, said heat-generating resistors being made from an electroconductive material;

plural pairs of electrodes, each pair corresponding to one of said heat-generating resistors and being made from the electroconductive material, each of said plural pairs of electrodes and each of said heat-generating resistors being formed in a continuous layer;

a plurality of flow paths for supplying ink to a position of each of said heat-generating resistors; and discharge openings for providing an ink discharge, wherein a resistance value of each of said heat-generating resistors is made greater than the resistance value of said corresponding pair of electrodes by oxidizing a part of said electroconductive material and wherein said electricity-heat convertors having said heat-generating resistors and said pairs of electrodes formed as the continuous layer are insulatedly separated by an oxidized layer of the electroconductive material.

2. The ink jet recording head according to claim 1, wherein the oxidation comprises anodic oxidation of said electroconductive material.

3. The ink jet recording head according to claim 1, wherein said electroconductive material is selected from the group consisting of Ta, V, Nb, Zr, Mg, Zn, Ni, Gd and Co.

4. The ink jet recording head according to claim 1, wherein the protective layer is further provided on at least part of each electricity-heat convertor.

5. An ink jet recording head according to claim 1, wherein resistance value is measured per unit length in a direction from one electrode electrically connected to said heat-generating resistor to the other electrode.

6. An ink jet recording head according to claim 1, wherein ink exists in said flow paths.

7. A substrate for an ink jet recording head, said substrate comprising:

a support member;

a plurality of electricity-heat convertors disposed on said support member, each said electricity-heat convertor comprising a heat-generating resistor portion for generating heat energy and an electrode portion for supplying electrical energy to said heat-generating resistor portion, said heat-generating resistor and said electrode portions being formed from a same electroconductive material as a continuous layer and a resistance value of said heat-generating resistor portion is made greater than a resistance value of said electrode portion by oxidizing a part of the electroconductive material; and an insulating region provided in the layer continuous to both said heat-generating resistor portion and said electrode portion and comprising an oxidized portion of said electroconductive material, said insulating region being disposed between each of said plurality of electricity-heat convertors and insulatedly separating each of said plurality of electricity-heat convertors.

8. A substrate for an ink jet recording head according to claim 7, wherein the oxidizing includes anodic oxidation of said electroconductive material.

9. A substrate for an ink jet recording head according to claim 7, wherein said electroconductive material is selected from the group consisting of Ta, V, Nb, Zr, Mg, Zn, Ni, Gd and Co.

10. A substrate for an ink jet recording head according to claim 7, wherein a protective layer is further provided on at least part of each electricity-heat convertor.

11. A substrate for an ink jet recording head according to claim 7, wherein said oxided portion is provided between adjacent heat-generating resistor elements.

12. An ink jet recording head according to claim 7, wherein resistance value is measured per unit length in a direction from one electrode electrically connected to the heat-generating resistor to the other electrode.

* * * * *

UNITED STATES PATENT AND TRADEMARK OFFICE

CERTIFICATE OF CORRECTION

PATENT NO. : 5,210,549 Page 1 of 2

DATED : May 11, 1993

INVENTOR(S) : Hiroto TAKAHASHI

It is certified that error appears in the above-indentified patent and that said Letters Patent is hereby corrected as shown below:

COLUMN 1:

Line 13, "Background" should read --Background Art--;

Line 41, "is" should read --are--; "side" should be deleted;

Line 46, "head" should read --a head--.

COLUMN 2:

Line 31, "also" should be deleted.

COLUMN 3:

Line 31, "shows" should read --show--;

Line 34, "shows" should read --show--;

Line 61, "thereof, a" should read --thereof. A--; "is. A" should read --is a--.

COLUMN 4:

Line 20, "plate and" should read --plate; and--.

UNITED STATES PATENT AND TRADEMARK OFFICE

CERTIFICATE OF CORRECTION

PATENT NO. : 5,210,549

DATED : May 11, 1993

INVENTOR(S) : Hiroto TAKAHASHI

It is certified that error appears in the above-indentified patent and that said Letters Patent is hereby corrected as shown below:

COLUMN 7:

Line 30, "the" should read --a--.

COLUMN 8:

Line 34, "oxided" should read --oxidized--;

Line 36, "An ink" should read --A substrate for an ink --.

Signed and Sealed this

Seventh Day of June, 1994

Bruce Lehman

*Attest:*

BRUCE LEHMAN

*Attesting Officer*

*Commissioner of Patents and Trademarks*